United States Patent [19]

Ushio et al.

[11] 4,144,993

[45] Mar. 20, 1979

[54] METHOD OF PRODUCING A CONTINUOUS CASTING MOLD

[75] Inventors: Tetsuji Ushio; Satoru Tatsuguchi; Hoshiro Tani, all of Kitakyushu, Japan

[73] Assignee: Mishima Kosan Co., Ltd., Fukuoka, Japan

[21] Appl. No.: 861,003

[22] Filed: Dec. 15, 1977

[30] Foreign Application Priority Data

Sep. 20, 1977 [JP] Japan ..... 52-113117

[51] Int. Cl.[2] ..... B22D 9/06; B22D 11/00

[52] U.S. Cl. ..... 228/107; 427/383 C; 249/116; 164/418; 427/135; 164/138; 204/26; 228/231

[58] Field of Search ..... 428/675; 249/115, 116; 164/273 R, 82, 138, 418; 427/135; 204/43 T, 26, 43 R; 228/107

[56] References Cited

U.S. PATENT DOCUMENTS

| | | | |
|---|---|---|---|
| 2,212,984 | 8/1940 | Greed | 249/116 |
| 3,204,917 | 9/1965 | Richards | 249/116 |
| 3,792,986 | 2/1974 | Scott | 249/115 |
| 3,812,566 | 5/1974 | Clauss | 428/675 |
| 4,037,646 | 7/1977 | Hara | 249/116 |

*Primary Examiner*—Sam Silverberg

*Attorney, Agent, or Firm*—Wenderoth, Lind & Ponack

[57] ABSTRACT

In a continuous casting mold of a copper alloy havng a nickel layer plated on the mold cavity surface, wherein an alloy layer of nickel containing one of Co, Fe and Mn and 3–5 mm thickness replaces the Ni layer.

3 Claims, 29 Drawing Figures

METHOD OF PRODUCING A CONTINUOUS CASTING MOLD

BACKGROUND OF THE INVENTION

The present invention relates to method of producing a continuous casting mould, and more particularly to copper or copper alloy mold lined by hard metal, e.g., nickel or chromium.

Conventionally chromium plating the casting cavity of the copper mold has been used. However, as the plated layer tends to separate from the base mold, and as the chromium plated layer has poor heat conductivity, disavantages occurred for practical use for continuous casting.

Nickel plating on the casting cavity of the copper or copper alloy mold was proposed. Since the nickel plating adheres firmly with the copper mold, and the cooling effect is also superior compared with the chromium plating, the nickel plating is widely used.

Japanese Patent Application Publication No. 9169 of 1977 describes a method wherein nickel containing 3–13 weight percent phosphorus is plated by non electrolytic plating on a copper mold for less than 0.3 mm, and the plated layer is heat treated. Since the plated layer is thin, early wear occurs and results in short life. Especially, when copper is exposed at the lower side of the mold, the copper tends to mix in cast steel, and also cracks tend to be produced by over cooling.

Nickel plating of about 3 mm thickness can be cast about 1,000 charges by once or twice effecting intermediate surface cutting, and that of about 5 mm thickness can be cast about 1,600 charges by 3–5 times of intermediate surface correction cutting. However, such nickel plated layer tends to produce surface cracks, as shown in FIG. 1, along the border line of the crystal grains. The crack of FIG. 1 shows a mold surface after 500 charges of casting.

Japanese Patent Laid Open Publication No. 147,431 of 1976 describes an electric plating layer consisting, at least, of one of nickel and cobalt on copper or a copper alloy mold and a surface layer consisting of one of nickel and cobalt and one of phosphorus and boron on the plated layer. The surface layer is about 20–100$\mu$ thickness, which is too thin and wears off after only about 100 casting charges. Further, the process describes no heat treatment so that firm adherence of the plated layer on the copper mold cannot be expected, especially on a precipitation hardened copper mold.

Japanese Patent Application Publication No. 28255 of 1973 describes that nickel plating on a copper mold cavity surface is heated in a non oxidation atmosphere of about 600°–1,000° C. to produce a nickel-copper diffusion layer between the nickel and copper metals.

Some of the above described surface layers are too thin to stand many casting charges, and all of the nickel layers on the copper mold cavity contain problems of heat crack and wear resistance.

SUMMARY OF THE INVENTION

The inventors of the present invention recognized that, heat cracks on a nickel plated layer of a continuous casting mold cavity surface are based on the property changes of nickel at high temperature as nickel has low recrystallization temperature and transformation point. As the nickel layer has very high affinity and adherence force to copper or copper alloy surface and results in high durability to heat stress and mechanical wear, material or materials suitable for surface layer to be searched must have properties of high recrystallization temperature and high transformation point and also of high affinity and adherence force to copper and copper alloy.

Thus, the object of the present invention is to provide a method of producing a continuous casting mold which improves the heat crack and wear resistance properties to enable high speed continuous casting.

According to the present invention, to attain the above mentioned objects, an alloy layer consisting mainly of nickel and containing at least one of cobalt, iron and manganese is formed on copper or copper alloy mold cavity surface, and the mould is heat treated.

BRIEF DESCRIPTION OF THE DRAWING

FIGS. 1–5 show a microscopic crystal structure of 400 magnification, among which:

FIG. 1 shows heat cracks on a known nickel layer plated on copper mold cavity surface;

FIGS. 2 and 3 show surface and section structures, respectively, of a known nickel plated layer, in which (A) shows no heat treatment, (B) shows heat treated at 400° C., (C), (D), (E) and (F) show heat treated at 425° C., 450° C., 475° C. and 500° C. respectively; and FIGS. 4 and 5 show an 80% nickel and 20% cobalt alloy layer and a 60% nickel and 40% cobalt alloy layer, respectively, according to the present invention, on the copper mold cavity surface, and in which (A)–(D) show surface structures and (E)–(H) show section structures, and also in which (A) and (E) show no heat treatment, (B) and (F) show heat treated at 300° C., (C) and (G) show heat treated at 400° C. and (D) and (H) show heat treated at 500° C.

DESCRIPTION OF PREFERRED EMBODIMENTS

Figure 1:
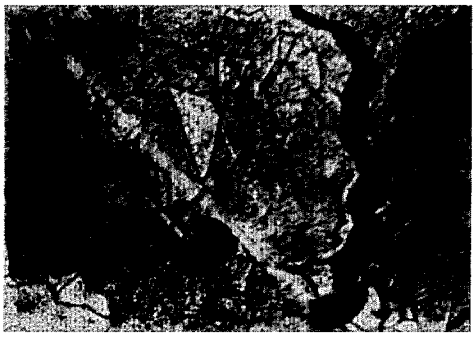
Figure 2A:
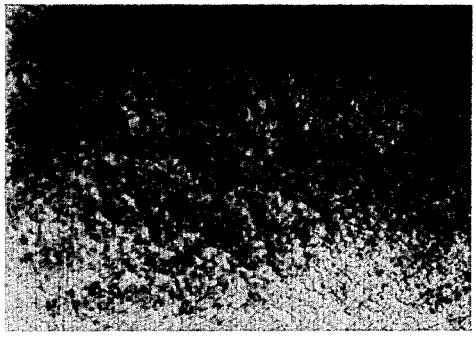
Figure 2B:
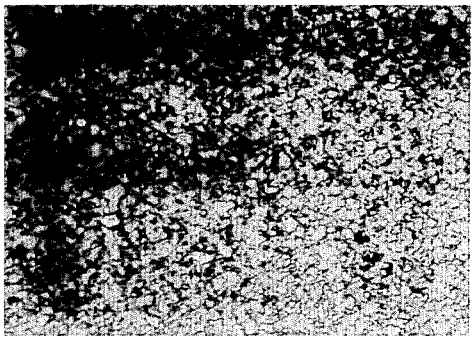
Figure 2C:
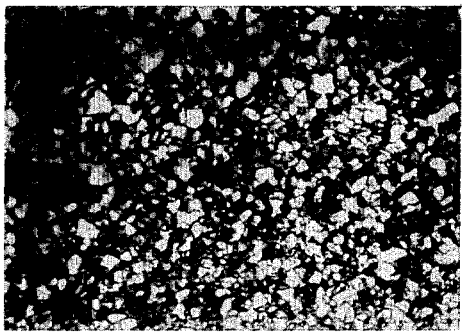
Figure 2D:
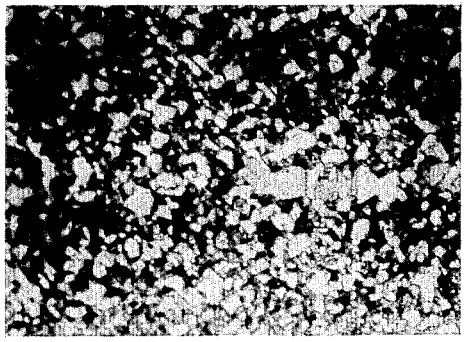
Figure 2E:
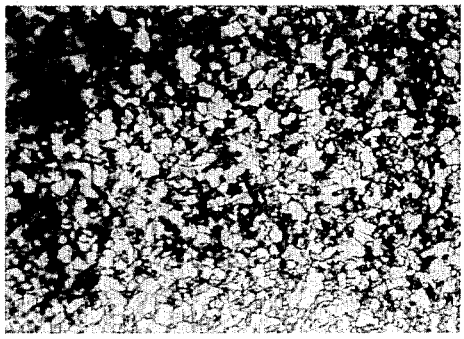
Figure 2F:
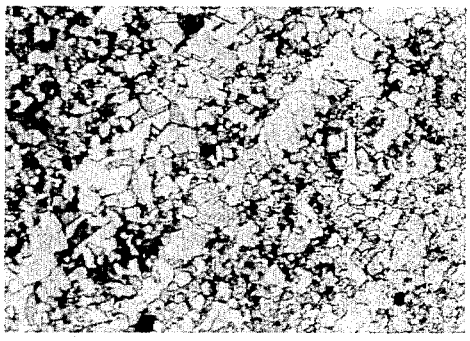
Figure 3A:
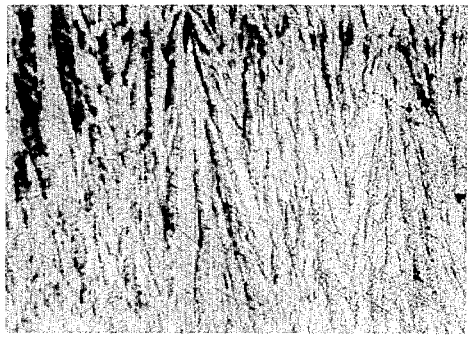
Figure 3B:
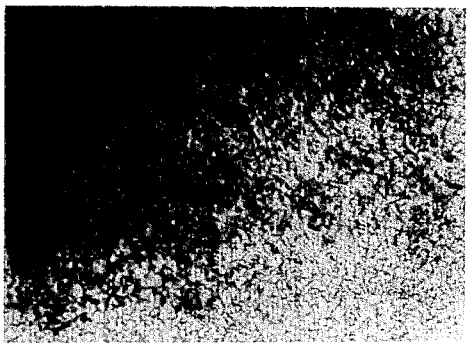
Figure 3C:
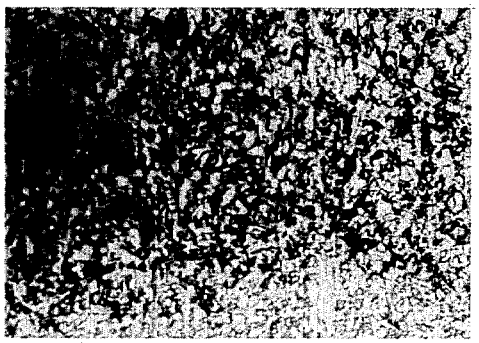
Figure 3D:
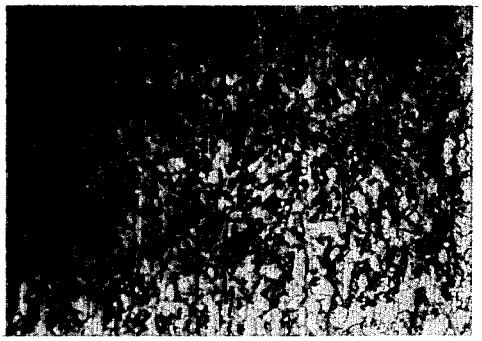
Figure 3E:
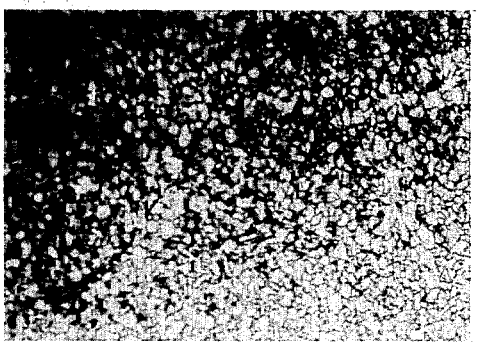
Figure 3F:
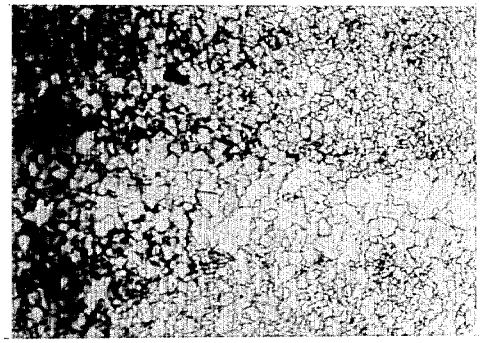
Figure 4A:
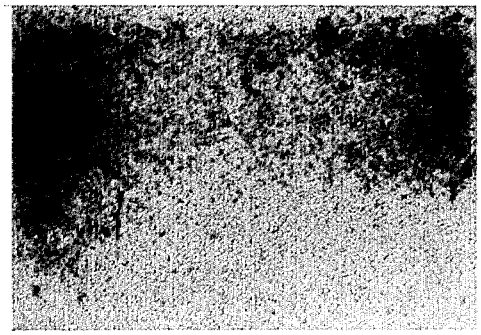
Figure 4B:
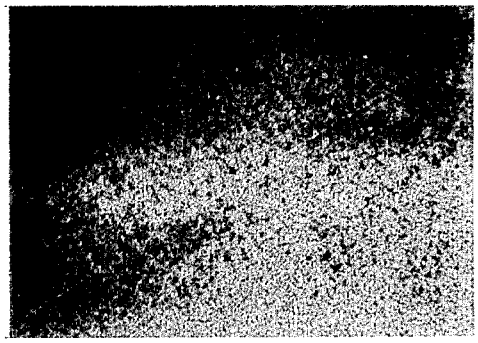
Figure 4C:
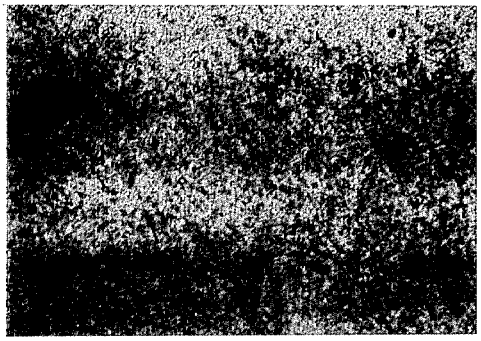
Figure 4D:
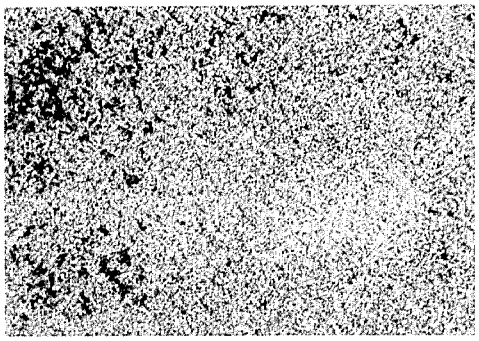
Figure 4E:
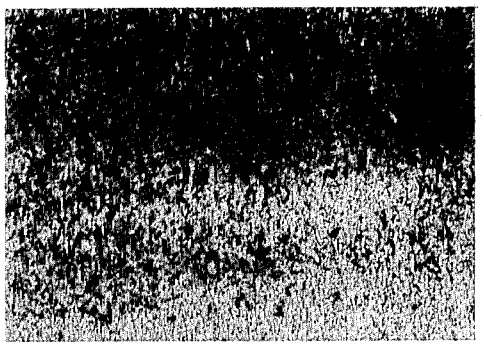
Figure 4F:
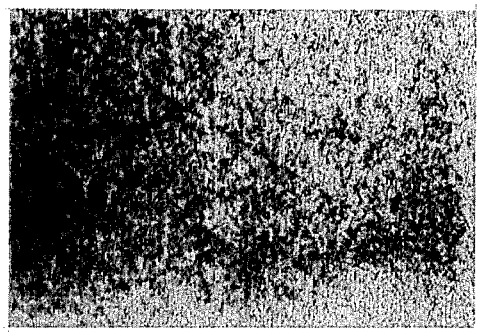
Figure 4G:
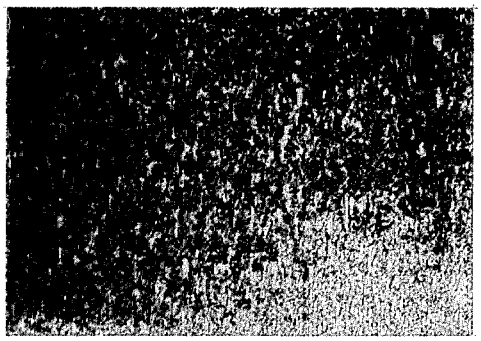
Figure 4H:
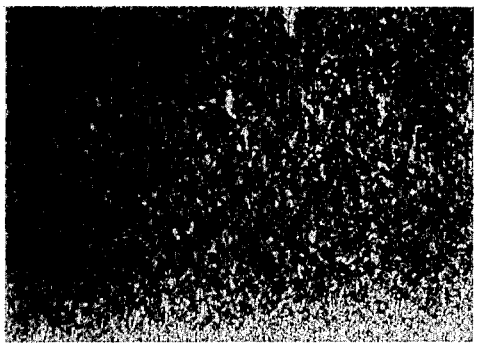
Figure 5A:
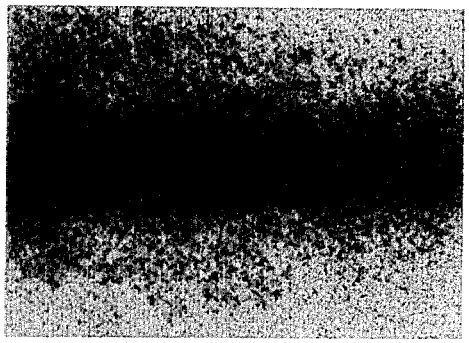
Figure 5B:
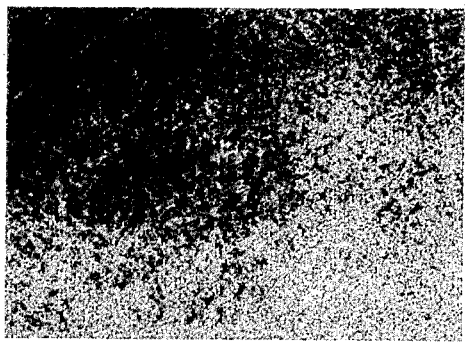
Figure 5C:
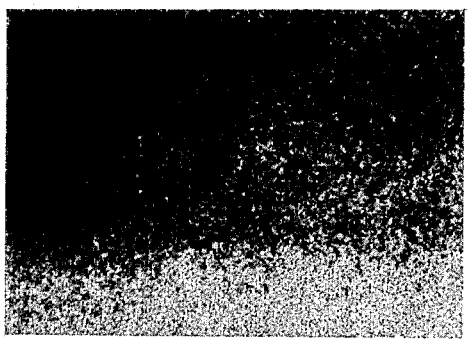
Figure 5D:
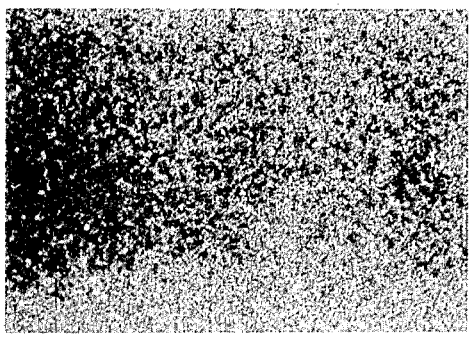
Figure 5E:
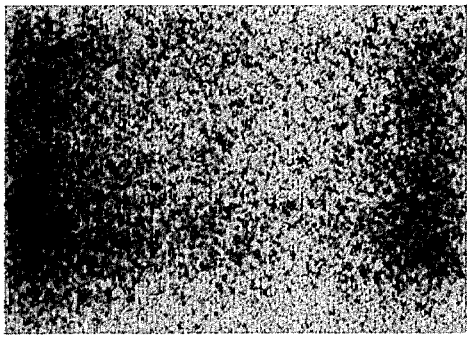
Figure 5F:
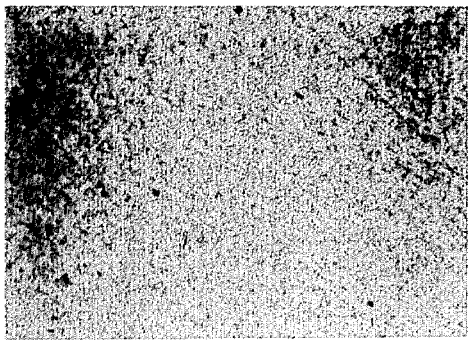
Figure 5G:
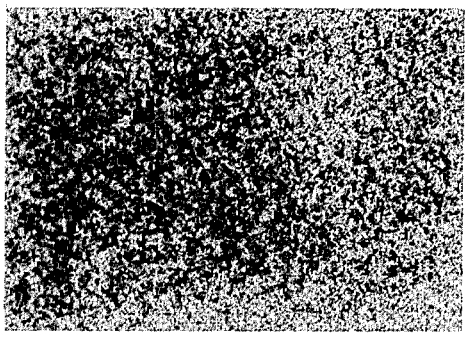
Figure 5H:
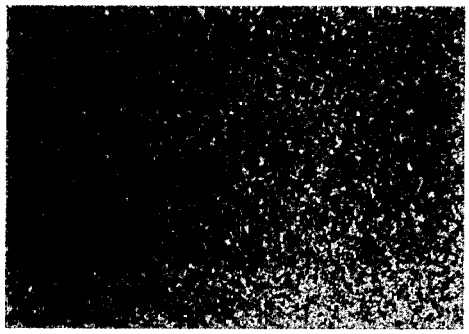

The method of producing a mold for a continuous casting, according to the invention is described based on the following examples.

EXAMPLE I

A. Mold body
material: precipitation hardened copper alloy
dimension: 704W × 2485L × 60T mm B. Nickel-cobalt alloy layer on the mold cavity surface
plating condition:
nickel metal: 75–100 g/l
metal cobalt: 3–10 g/l
boric acid: 25–35 g/l
pH: 4.0–4.6
liquid temperature: 45°–55° C.
current density 5–10 A/dm$^2$
thickness of plating: 3–5 mm C. Heat treatment
300°–500° C. in ordinary atmosphere.

EXAMPLE II

| | |
|---|---|
| A. Mold body<br>C. Heat treatment | same as Example I. |

B. Nickel-iron alloy layer plated on the mold cavity surface
plating condition:
nickel metal: 75–100 g/l iron metal: 1–10 g/l
boric acid: 25–35 g/l
pH: 4.0–4.3
liquid temperature: 45°–55° C.
current density: 5–10 A/dm$^2$
thickness of plating: 3–5 mm

EXAMPLE III

| | |
|---|---|
| A. Mold body<br>C. Heat treatment | same as Example I. |

B. Nickel-manganese alloy layer plated on the mold cavity surface plating conditon:
nickel metal: 75–100 g/l
manganese metal: 2–5 g/l
boric acid: 25–35 g/l
pH: 4.0–4.6
liquid temperature: 45°–55° C.
current density: 5–10 A/dm$^2$
thickness of plating: 3–5 mm In practical use, these molds described in the Examples I - III according to the present invention have 50% longer life, i.e., 1,500–2,400 charges corresponding to plate layer thickness of 3–5 mm than the above mentioned life of a conventional nickel plated mold of the same thickness range. Further, the slow cooling effect of the molds according to the Examples I–III, improve the surface property of the cast steel by decreasing surface cracks so that surface cracks removal work is substantially decreased and yield is also improved.

Table I shows properties of the alloy layers shown in the Examples I–III compared with a conventional nickel layer.

Table I

| microscopic structure | ord. temp. after h.t. | 100% Ni dendrite crystal border (400° C) ord. temp. | 100% Ni dendrite crystal border (400° C) 400° C. | 65 Ni - 35 Co ord. temp. | 65 Ni - 35 Co 400° C. | 80 Ni - 20 Fe fine structure fine structure (500° C) ord. temp. | 80 Ni - 20 Fe fine structure fine structure (500° C) 400° C. | 85 Ni - 15 Mn ord. temp. | 85 Ni - 15 Mn 400° C. |
|---|---|---|---|---|---|---|---|---|---|
| adhere force (kg/mm$^2$) | | 18 | 25 | 18 | 25 | 18 | 25 | 18 | 25 |
| hardness (HMV) | | 230 | 170 | 430 | 320 | 550 | 410 | 400 | 300 |
| tensile strength (Kg/mm$^2$) | | 50 | 42 | 100 | 80 | 115 | 90 | 80 | 60 |
| elongation (%) | | 20 | 26 | 10 | 15 | 8 | 13 | 13 | 18 |
| recrystalization temperature (° C) | | 400 | | 620 | | 580 | | 570 | |
| transformation point (° C) | | 352 | | 800 | | 560 | | 550 | |
| melting point (° C) | | 1,453 | | 1,470 | | 1,490 | | 1,150 | |
| heat conductivity (cal/cm sec° C) | | 0.22 | | 0.20 | | 0.21 | | 0.21 | |
| linear expansion (/° C) | | $13.3 \times 10^{-6}$ | | $13.0 \times 10^{-6}$ | | $13.0 \times 10^{-6}$ | | $14.6 \times 10^{-6}$ | |

Microscopic structures are shown in FIGS. 1–5, in which FIGS. 1–3 show conventional 100% Ni layer and FIGS. 4 and 5 show Ni-CO alloy layers, as the crystal structures of the layers Ni-Co, Ni-Fe and Ni-Mn are nearly similar, so that the Ni-Co layer can represent the layers according to the invention.

More particularly, FIGS. 2 and 3 show surface and section structures, respectively, of known 100% Ni plated layer, in which (A) shows no heat treatment, and (B), (C), (D), (E) and (F) show heat treated at 400° C., 425° C., 450° C., 475° C. and 500° C., respectively.

FIGS. 4 and 5 show 80% Ni—20% Co alloy and 60% Ni—40% Co alloy layer according to the present invention, respectively. The structures are shown by 400 magnification which is same to all figures. In FIGS. 4 and 5 (A)–(D) show surface structures and (E)–(H) show section structures. (A) and (E) show no heat treatment, (B) and (F) show heat treated at 300° C., (C) and (G) at 400° C., and (D) and (H) at 500° C.

As shown clearly in the FIGS. 1–5, the surface layers shown in FIGS. 4 and 5 have a very fine crystal structure compared with the Ni layers shown in FIGS. 2 and 3, and the structure is stable even at high temperature.

This is clearly shown in the Table I, that the layers according to the invention have a high recrystallization temperature and transformation point so that the crystal structure is stable at high temperature. The hardness and tensile strength are about twice those of the nickel layer. The high adherence force shown in the Table I clearly proves that plate layer separation of a conventional chromium plate layer does not occur.

It will be appreciated that the mold having one of the surface layers according to the present invention has a longer service life than known molds, and solves the problems of surface cracking and separation of known molds.

In the embodiments, the surface layers according to the invention are electrically plated. Other methods, i.e., explosion plating can also be utilized.

What is claimed is:

1. A method of producing continuous casting mold comprising the steps of:

forming an alloy layer consisting mainly of nickel and containing at least one member selected from the group consisting of iron and manganese on a copper or copper alloy mold cavity surface; and heat-treating the mold.

2. A method according to claim 1 in which said copper alloy mold is formed by a precipitation hardenable copper alloy.

3. A method according to claim 1, wherein the mold is heat-treated at a temperature between 300° C. and 500° C.

* * * * *